United States Patent [19]

Cycowicz et al.

[11] 4,194,783

[45] Mar. 25, 1980

[54] WALL PROXIMITY CHAIRS AND HARDWARE THEREFOR

[75] Inventors: Izchak Cycowicz, Brooklyn; Alfred Frimmet, Larchmont, both of N.Y.

[73] Assignee: Mohasco Corporation, Amsterdam, N.Y.

[21] Appl. No.: 781,544

[22] Filed: Mar. 28, 1977

[51] Int. Cl.[2] ..... A47C 1/02; F16M 13/00

[52] U.S. Cl. ..... 297/88; 248/429; 297/322

[58] Field of Search ..... 297/85, 83, 322, 90, 297/88; 312/332, 341 NR, 341 R; 308/3.9; 16/DIG. 6; 248/430, 429; 5/200

[56] References Cited

U.S. PATENT DOCUMENTS

| | | | |
|---|---|---|---|
| Re. 28,210 | 10/1974 | Re' | 297/83 |
| 135,052 | 1/1873 | Wetmore | 151/33 |
| 353,640 | 11/1886 | Nourse | 312/341 R |
| 1,726,002 | 8/1929 | Smith | 312/332 |
| 1,961,653 | 6/1934 | Van Deest | 248/429 |
| 2,523,821 | 9/1950 | Fox | 312/342 |
| 2,653,852 | 9/1953 | Bissman | 312/341 NR |
| 2,683,481 | 7/1954 | Lorenz | 297/90 X |
| 2,752,219 | 6/1956 | Vonkers | 312/341 |
| 3,039,838 | 6/1962 | Koch, Jr. et al. | 312/348 X |
| 3,649,090 | 3/1972 | Dutot | 308/3.6 |
| 3,679,274 | 7/1972 | Nance | 312/341 R |
| 3,702,179 | 11/1972 | Radke et al. | 248/430 |
| 3,826,532 | 7/1974 | Caldemeyer | 297/270 |
| 3,941,417 | 3/1976 | Re' | 297/85 |
| 3,958,827 | 5/1976 | Re' | 297/322 |
| 4,027,343 | 6/1977 | Hooker | 5/200 R |

*Primary Examiner*—James T. McCall

*Attorney, Agent, or Firm*—Kirschstein, Kirschstein, Ottinger & Cobrin

[57] ABSTRACT

This invention adds a stabilizing system to the chair disclosed in our copending application Ser. No. 618,954, filed Oct. 2, 1975, and minimizes swaying side to side, and thereby maintaining the rigidity of the chair. The stabilizing system comprises a pair of paralleled base plates attached to front and rear cross-rails supported on the floor. Arm mounting members are attached to the left and right side arms of the chair, respectively. Friction reducing buttons on said arm mounting members movably contact said base plates. At least one of said buttons is adjustable to ensure retaining said chair against swaying sideways. A button at each side of the chair, is attached to one link of the arm rest suspension linkage, to slidably contact another link of the suspension linkage, to also aid in preventing side sway of the chair. The cross-rails extend beyond the base plates and beyond the inner surfaces of the side arms of the chair. The cross-rails can extend to the outer surfaces of the side arms, with supporting pads or glides mounted on the ends of the rails to increase stability of the chair, particularly against tilting sideways if excessive weight is imposed on one side of the chair. The rear cross-rail is vertical while the front cross-rail is horizontal, thereby giving rigidity to the parallel base plates. The base plates are supported on the cross-rails and the rest of the chair is supported on the base plates. Parts of the base plates are pushed out where the buttons contact the base plates in the upright position of the chair, for increased rigidity in said upright position. Coil springs are employed to help ensure keeping the leg rest retracted in upright position of the chair.

9 Claims, 8 Drawing Figures

WALL PROXIMITY CHAIRS AND HARDWARE THEREFOR

This invention relates to improvements relating to wall proximity chairs.

One object of this invention is to improve the chair disclosed in our copending application Ser. No. 618,954, filed Oct. 2, 1975.

Another object of this invention is to provide a chair of the character described, with highly improved means to keep the chair from swaying side to side and increase the stability of the chair.

Another object of this invention is to provide a chair of the character described in which front and rear cross-rails are fixed to parallel base plates and extend beyond the inner surfaces of the side arms of the chair and beyond the base plates to increase the stability of the chair, particularly against sideway tilting of the chair if excessive weight is imposed on one side of the chair.

Another object of this invention is to provide a chair of the character described in which the front cross-rail is in a horizontal plane while the rear cross-rail is in a vertical plane. The front cross-rail is horizontal so that it can be as low as possible to clear the lower ends of the ottoman linkage, while the ottoman is projected from retracted position.

Yet another object of this invention is to provide in a chair of the character described, a highly improved stabilizing system for the means for suspending the side arms of the chair, comprising a pair of parallel base plates attached supportedly to front and rear cross-rails supported on the floor, arm mounting members being attached to the side arms of the chair, carrying friction reducing buttons slidably contacting said base plates as the chair is moved between upright position and extended position, one of said buttons being adjustable to compensate for lack of parallelism of the arm rests thereby to aid in preventing side sway of the chair seat.

Yet another object of this invention is to provide in a chair of the character described, push outs on the base plates to contact said buttons in the upright position of the chair to aid in eliminating sway side movement of the chair in said upright position.

Still another object of this invention is to provide a strong and durable chair and hardware therefor, which shall be relatively inexpensive to manufacture, easy to assemble and which shall yet be efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 3:
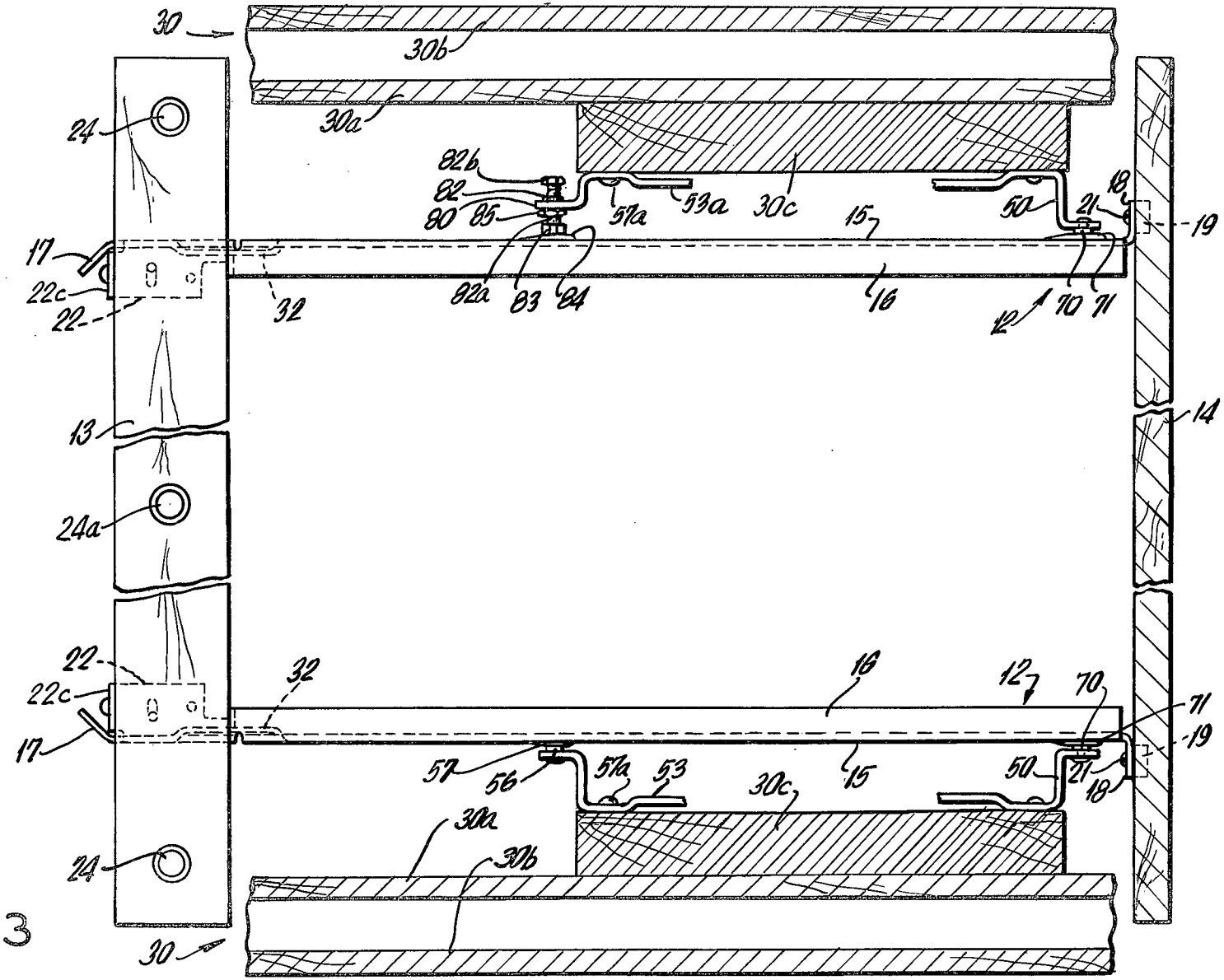
FIG. 3 is a bottom plan view of the base of the chair of FIGS. 1 and 2.

Referring now in detail to the drawing, 10 designates a chair embodying the invention. Said chair comprises a base 11. FIG. 3 is a bottom view looking up on the base 11. It comprises left and right parallel, symmetrical base plates 12 attached at their front ends to a front wood cross-rail 13 for support thereby, and at their rear ends to a rear wood cross-rail 14 for support thereby. The cross-rails, as shown in FIG. 3 of the drawing extend beyond the base plates 12.

Figure 2:
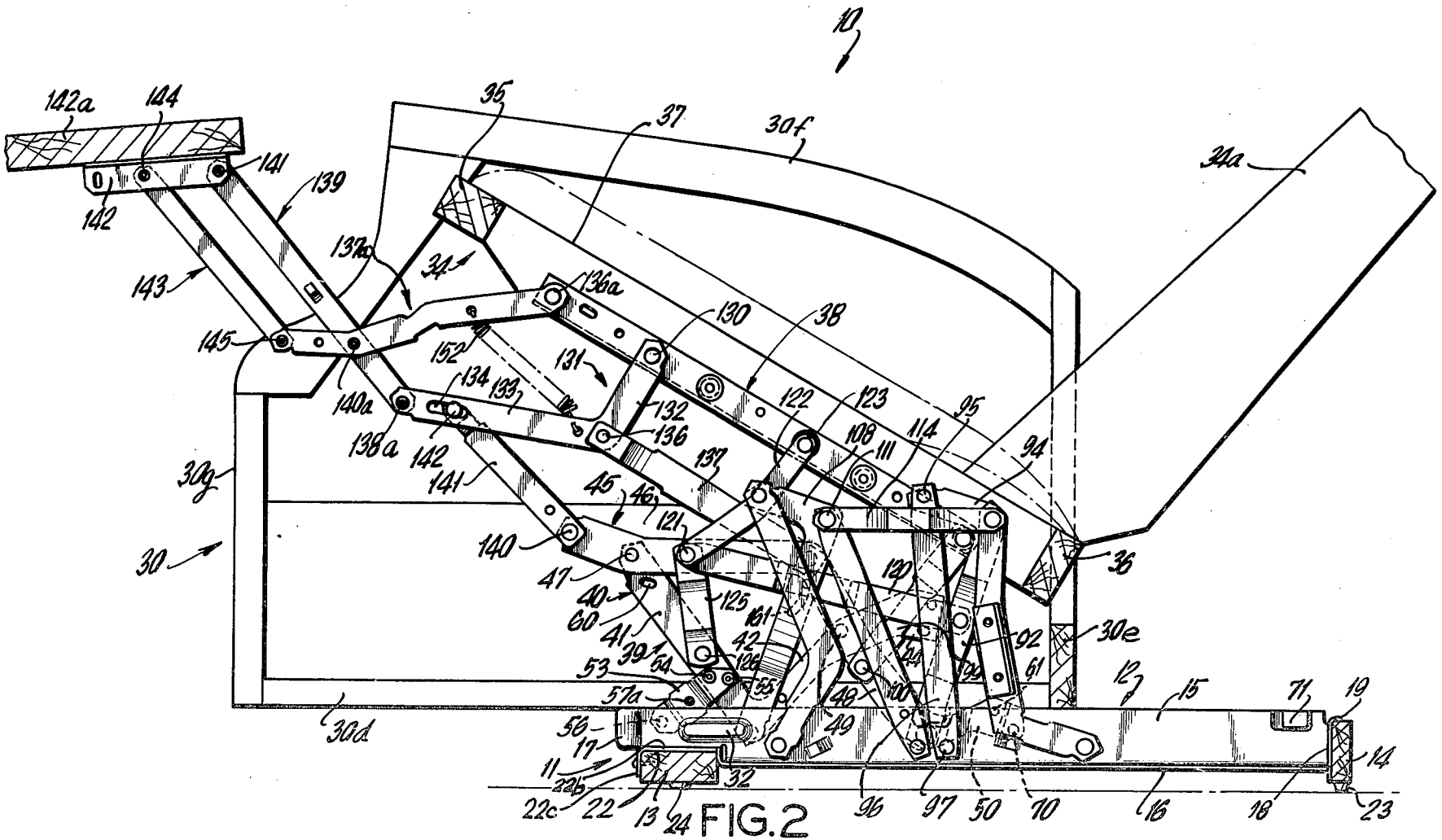
FIG. 2 is a view similar to FIG. 1 but showing the chair in fully extended condition.

Each base plate 12 comprises a flange 15 in a vertical plane extending from front to rear and from the lower end of which a horizontal flange 16 extends inwardly. Flange 15 has a front vertical edge 17 inclined inwardly in order to catch and deflect the linkage of the ottoman during end of retraction when uneven pressure is applied to the ottoman. Extending from the rear end of flange 15 is an outwardly extending vertical wing 18 provided with a top horizontal flange 19. Wing 18 extends down below the level of flange 16, as shown in FIG. 2. The rear cross-rail 14 contacts the rear faces of wings 18 and the undersurface of flanges 19 and are secured thereto by screws and/or bolts 21.

Figure 1:
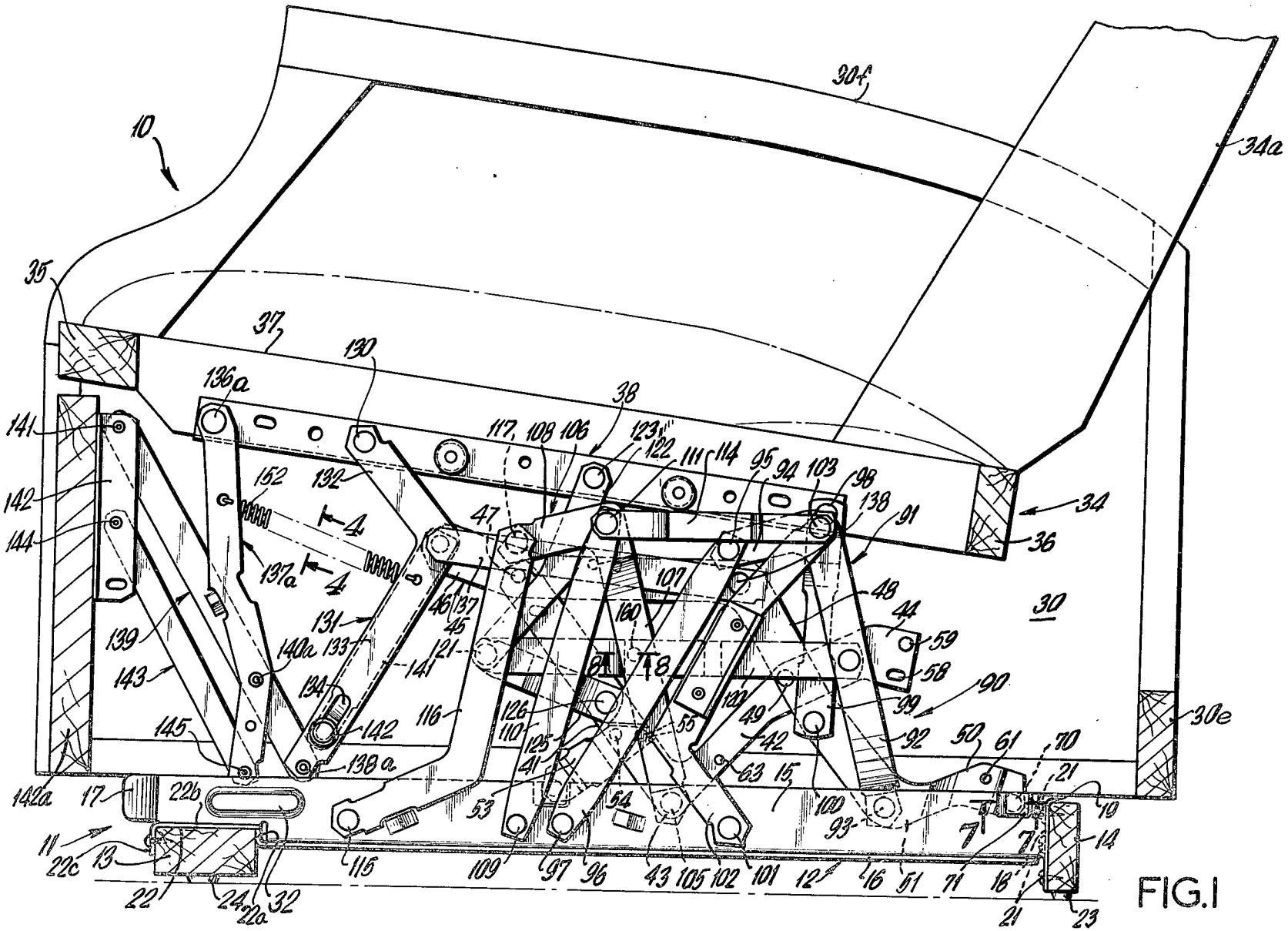
FIG. 1 is a side elevational view of the chair in upright position.
Figure 5:
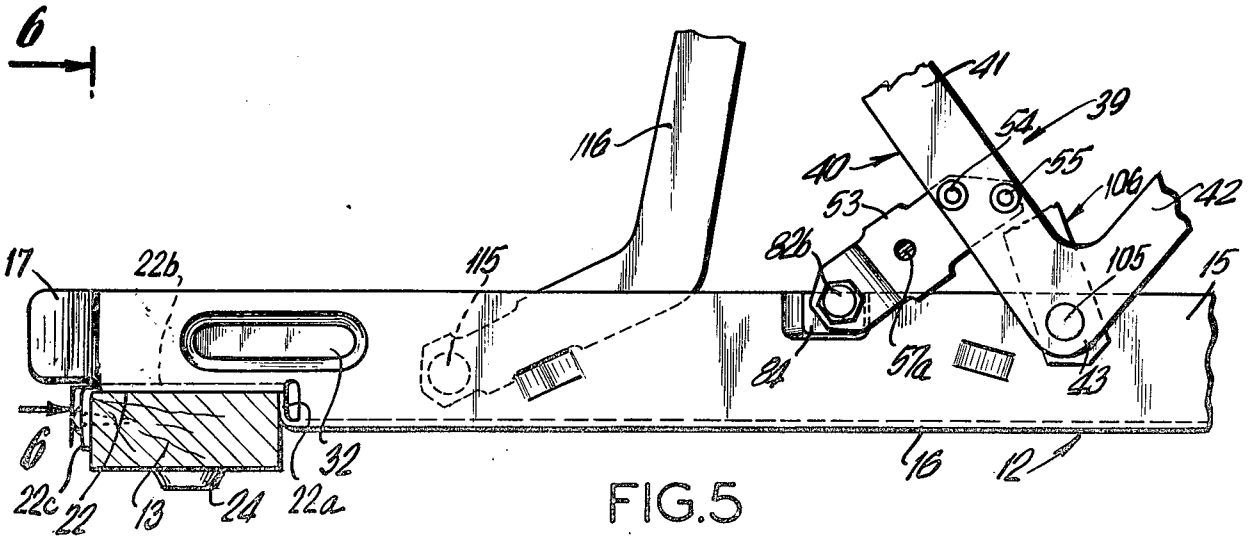
FIG. 5 is a partial vertical view of the lower left portion of the structure illustrated in FIG. 1.

At the front end of each base plate 12, there is a vertical under recess 22 receiving the front cross-rail 13, as shown in FIGS. 2 and 5. Cross-rail 13 is attached to the recess 22 by any suitable screws accessible from top and front. Said recess portions 22 each comprises a web **22*a* extending up from flange 16, a top web 22*b* and a downwardly extending flange 22*c*, as shown in FIG. 1. The front rail 13 partially extends above flange 16 and partially below flange 16. Pads or glides 23 are attached to the under edge of rear cross-rail 14. These pads or glides are disposed beyond the base plates 12. Also pads or glides 24 are attached to the underside of the front cross-rail 13, also disposed beyond the base plates 12. Cross-rail 13 may have a central glide 24*a*. With such construction the chair will not readily tilt if excessive weight is imposed on the side of the chair. The pads 23, 24** contact the floor on which the chair rests.

The chair 10 also comprises a body 25 having side arms 30 each having an inner vertical wall **30*a* and an outer vertical wall 30*b*, and a mounting block 30*c* at the inside of the inner wall 30. Said blocks 30*c* have portions aligned with outer ends of the arm mounting members 39, as will be described hereinafter. Side arms 30 are provided with usual front walls 30*g*, bottom walls 30*d*, rear walls 30*e* and with arm rests 30*f*. These side arms 30 are disposed vertically and are located at the outsides of the base plates and extend upwardly above the base plates. Said side arms are rigidly interconnected by a cross rail 30*f*** and by other cross rails, not shown, in the usual manner.

Said base plates may have horizontal inwardly pouched stiffening ribs 32 near their front ends.

The chair 10 further comprises a body supporting member 33 comprising a seat frame 34 having a front rail 35 and a rear wall 36 interconnected by parallel side rails 37. Fixed to the inside of each side rail 37 is a seat mounting link 38. Fixed to the seat frame 34 is a chair back **34*a*. Attached to the inner side of arm mounting block 30*c* of side arms 30 are arm mounting members 39. The members 39 on the right and left side are similar and symmetrically disposed. Hence the member 39 on the side shown in FIGS. 1 and 2** only will be described.

Also the seat mounting links 38 are mounted for movement relative to the base plates 12 and to the arm mounting members 39, (and hence relative to the side arms 30 to which said members are fixed), by similar symmetrically disposed linkages substantially similar to linkages which connect the seat mounting links 50 of our copending patent application, Ser. No. 618,954, filed Oct. 2, 1975, to the mounting plates 41 and arm mounting members 21 of said copending application. This linkage is described and shown in said copending application.

Said arm mounting member 39 comprises three pieces integrated into one subassembly. One piece 40 comprises a downwardly and rearwardly inclined arm 41 which reaches down below the level of the upper edge of base plate 12. Extending upwardly and rearwardly from the lower end of arm 41 is an arm 42 forming an elbow 43. Arm 42 has a rearwardly extending rear end 44. The second piece is designated by numeral 45 and comprises an arm 46 extending forwardly and crossing the upper end of arm 41 and therebeyond and riveted thereto by pin 47 which also serves as a stop pin for main pivot lever 137 in upright and T.V. positions. Extending downwardly and rearwardly from the rear end of arm 46 is an arm 48 which crosses arm 42 and is riveted thereto as at 49. Extending rearwardly from the lower end of arm 48 is an arm 50, making an elbow 51 therewith. The third piece of the arm mounting subassembly 39, is a guide support 53 riveted at its upper end by rivets 54, 55 to arm 41 and inclined downwardly and forwardly therefrom. At the right hand side of the chair, a slide button 56 is mounted on the lower end of member 53 and contacts an outer surface of the base plate 12 on the right hand side of the chair. When the chair is in upright position, as will appear hereinafter, button 56 contacts a pushed out pad 57 of the flange 15 (see FIG. 3).

The arm mounting member is fixed to the inner side of arm mounting block **30*c* of the side arm 30 by a screw 57*a* passing through a hole in member 53. The arm mounting member is also bolted and/or screwed to said block by bolts passing through slot 58 of arm 44 of the arm mounting member and through a slot 60 in arm 41, and through hole 61 in arm 50, and also through hole 63 in arm 42 of the subassembly. Numeral 59 is a stop pin against which the rear pivot link 99** contacts in T.V. and fully reclined positions, as will appear hereinafter.

On the arms 50, at both the left and right hand sides of the chair is a friction reducing button 70 contacting a pushed out pad 71 on the base plate, when the chair is in upright position, as shown in FIGS. 1 and 3 of the drawing.

As will appear hereinafter, when the chair moves to extended position, the buttons 56 and 70 move off the pushed out pads 57 and 71 and slide along the outer sides of flanges 15 of the base plates to the fully extended position of the chair, as shown in FIG. 2 of the drawing.

Figure 6:
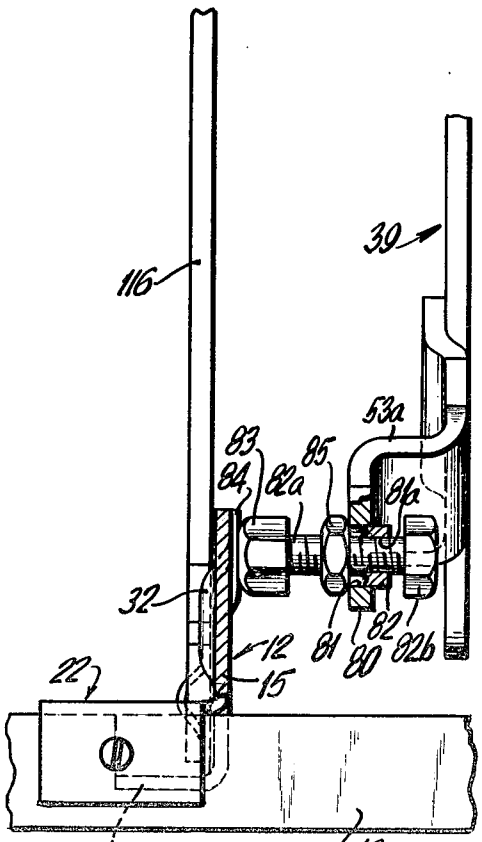
FIG. 6 is a cross-sectional view taken on line 6—6 of FIG. 5.
Figure 7:
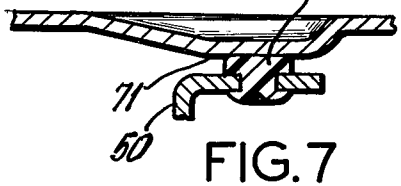
FIG. 7 is a cross-sectional view taken on line 7—7 of FIG. 1.
Figure 8:
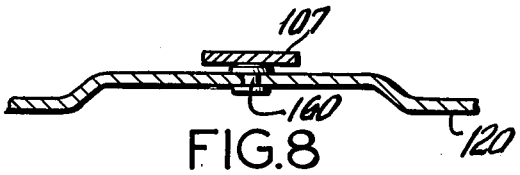
FIG. 8 is a cross-sectional view taken on line 8—8 of FIG. 1.
Figure 4:
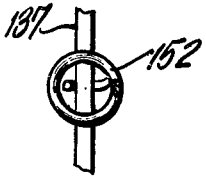
FIG. 4 is a cross-sectional view taken on line 4—4 of FIG. 1.

The arm mounting subassembly at the left hand side of the chair differs from the subassembly on the right hand side of the chair in that instead of a fixed friction reducing button 56 on member 53, on the right hand side, the left hand side has an adjustable button. Instead of member 53 there is utilized on the left hand side, a member **53*a* riveted to arm 41 of the arm mounting subassembly of the left hand side. Arm 53*a* has an offset tongue 80 formed with a hole 81 in which is fixed a bushing 82 formed with a horizontal central internally threaded hole 81*a*. Screwed through threaded hole 81 is a screw shank 82*a*. Said screw shank 82*a* carries a slide button 83 adapted to be adjusted into contact with a push out pad 84 on flange 15 of the base plate 12 on the left hand side of the chair, when the chair is in upright position of FIGS. 1, 3 and 6 of the drawing. The screw shank 82*a* has a polygonal head 82*b*. Screwed to the shank 82*a* between the tongue 80 and the button 83 is a lock nut 85**.

The suspension linkage for the seat links 38 from the arm mounting member 39 and the base plates 12 will now be described.

The suspension linkage on both sides are similar and symmetrically disposed.

Said linkage designated by numeral 90, comprises a rear swing link 91. Said rear swing link 91 comprises an arm 92 slanting upwardly and forwardly and pivoted at its lower end, as at 93, to elbow 51 between arms 48 and 50 of member 45 which is part of the arm mounting member 39. The upper end of arm 92 is near the rear end of the seat link 38 in the upright position of the chair (FIG. 1). Extending forwardly from the upper end of arm 92 is an arm 94. Pivoted to the forward end of arm 94, as at 95, is the upper end of a rear shift link 96 slanting downwardly and forwardly and pivoted at its lower end, as at 97 to flange 15 of base plate 12.

Pivoted to the rear end of seat link 38, as at 98 is the upper end of a rear pivot link 99, the lower end of which is pivoted, as at 100 to arm 48 of the arm mounting member 39.

Pivoted to base plate 12 rearwardly of pivot 97, as at 101 is the lower end of a rear suspension link 102, the upper end of which is pivoted, as at 103, to the rear swing link 91 at the junction of arms 92, 94 of said rear swing link.

Pivoted to the junction 43 between arm 41, 42 of member 40 of the arm mounting member 39, as at 105, is the lower end of a front swing link 106. Said front swing link 106 comprises an arm 107, the lower end of which is pivoted at 105 as described above. Arm 107 slants somewhat upwardly and forwardly in the upright position of the chair as illustrated in FIG. 1. Extending at substantially right angles to the upper end of arm 107, inclined forwardly and downwardly is an arm 108. Rear and front swing links 91, 106 are substantially similar in shape. Pivoted to flange 15 of base plate 12, at a point somewhat forwardly of pivot 97, as at 109 is the lower end of a front suspension link 110. The upper end of said front suspension link 110 is pivoted to the rear end of arm 108 of the front swing link 106 by pivot pin 111. Pivots 111 and 103 are interconnected by a stabilizing link 114.

Pivoted to the base plate 12 as by pivot 115 is the lower end of a front shift link 116. Pivot 115 is disposed forwardly of pivot 109. The upper end of the front shift link 116 is pivoted, as at 117 to the forward end of arm 108 of the front swing link 106. A drive link 120 is pivoted at one end to about the midpoint of arm 92, of the rear swing link 91. The front end of drive link 120 is pivoted by a pivot pin 121 to the lower end of a long sequence link 122. The upper end of the long sequence link 122 is pivoted, as at 123 to the seat link 38, forwardly of the rear end of said seat link. Pivot pin 121 is connected by a short sequence link 125 to a pivot pin 126 on arm 41 of the arm mounting member 39.

Pivoted to the seat link 38 as at 130 is one end of a sequence link 131. Pivot pin 130 is located forwardly of pivot pin 123, but rearwardly of the front end of the seat link 38. Said sequence link 131 has an upper arm 132 the upper end of which is pivoted to the seat link at 130. In the upright position of the chair, (FIG. 1), arm 132 slants downwardly and rearwardly. Extending from arm 132 is an arm 133 slanting downwardly and forwardly (FIG. 1). Said arm 133 is formed with a short slot 134 near its lower end. At the junction of arms 132, 133 is a pivot pin 136 connected by a main pivot lever 137 to a pivot pin 138 at the junction of arms 46 and 48 of part 45 of the arm mounting member 39. At the end of forwardly extending end 46 of said part 45 and disposed forwardly of stop pin 47 is a pivot pin 140 which pivotally connects one end of a guide link 141 to said arm 46. At the opposite end of guide link 141 is a pin 142 slidably engaged in slot 134 of the arm 133. Pivoted to the forward end of seat link 38 as at **136*a* is one end of an ottoman drive link 137*a*. Pivoted to the lower end of arm 133 of link 131, as at 138*a* is the lower end of an ottoman link 139, crossing link 137*a* and pivoted thereto as at 140*a*. The upper end of link 139 is pivoted as at 141 to an ottoman angle 142. A second ottoman link 143 is pivoted at its upper end as at 144 to said ottoman angle 142, and at its lower end, as at 145, to the lower end of ottoman drive link 137*a***.

An extension coil spring 152 interconnects an upper end of link **137*a* with arm 133 of sequence link 131 to and in moving the ottoman toward retracted position. Any suitable ottoman, as shown at 142*a*, interconnects the ottoman angles 142** at the right and left sides of the chair.

The chair disclosed herein may be placed near a fixed wall disposed behind the chair. As the chair is moved from upright position to T.V. partially reclined position and then to the fully reclined position of FIG. 2, the body supporting means and chair body move forwardly so that the back of the chair body supporting member 33 does not touch the wall. As the chair moves from upright to reclined position, the ottoman angles are projected, and as the chair is moved back to upright position the ottoman angles are retracted to the upright position of the chair. These operations are described in our copending application, Ser. No. 618,954, filed Oct. 2, 1975 and need not be repeated.

During such movements, the arm mounting members, being suspended, swing somewhat and their lower ends move slightly vertically as well as horizontally. Hence slide buttons 56, 79, 83 also move both horizontally and vertically.

Fixed to drive link 120 is a slide button 160 contacting the adjacent surface of arm 107 of the front swing link 106. The path of contact of said button 160 with arm 107 is outlined at 161 in FIG. 2 of the drawing. The contact of button 160 with arm 107 is substantially centrally located with respect to the linkage 90 and helps to eliminate side sway in the linkage.

The sequence of operations to fix the base plates to the cross-rails to achieve stabilization will now be described.

With the chair in inverted position, as shown in FIG. 3, projections 71 of the base plates are first moved against rear buttons 70 on the arm mounting subassemblies 39, and then screwed to the vertical rear cross-rail 14. Then the base plates are moved to exact parallel relation to each other by means of any suitable fixture, and then attached to the front cross-rail 13 in parallel relation to each other. Thereafter the adjustment screw **82*a* on the front left hand side of the chair, is adjusted relative to the adjacent base plate projection 84, to cause button 83 to move the paralleled base plates to cause the other base plate to slidably contact the button 56 against projection 57. Then the lock nut 85 is manipulated to lock the adjustment screw 82*a*** in adjusted position, so that all four buttons contact push outs on the base plates. Side sway will thereafter be prevented.

All the push outs 71, 56, 84 on the base plates have forwardly and inwardly inclined surfaces to ease rearward movement of the arms of the chair and to tighten the movement of the chair to upright position of greater rigidity or stability.

The cross-rails extend beyond the base plates. In fact, they can extend beyond the inner surfaces of the side arms of the chair up to the outer surfaces of said side arms, to help prevent tilting of the chair if excessive weight is applied to one side or the other of the chair. Thus, the pads or glides are placed at the undersides of the ends and of the middle of the front rail and the outer ends of the rear cross-rails and not on the base plates, as in former construction.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

We claim:

1. In a wall-proximity reclining chair of the type having (A) a stationary base for supporting the chair on a floor;

(B) body-supporting means including a seat located generally above the base, and a backrest located generally rearwardly of the seat; and (C) a movable armrest assembly mounted for movement relative to the base along a front-to-back horizontal longitudinal direction, and concomitantly somewhat along a generally vertical direction, said armrest assembly including (1) a pair of armrests transversely spaced apart of each other along a lateral direction generally perpendicular to the front-to-back longitudinal direction, each armrest having an inner wall which faces towards the seat, and (2) means for interconnecting the armrests for moving the latter jointly in response to manual urging on the armrests by a seated user;

the improvement comprising:

(a) a pair of base rails having base walls which extend both along the longitudinal and the vertical directions, said base walls being spaced apart of each other in lateral direction underneath the seat;

(b) linkage means interconnecting the armrests, the body-supporting means and the base rails, and operative for moving the body-supporting means along the longitudinal and vertical directions between (i) an end-limiting upright position in which the seat is oriented in a sitting orientation and is spaced a predetermined distance away from a room wall behind the chair, and (ii) an end-limiting fully-reclined position in which the seat is oriented in a different reclined orientation, and is spaced at a distance greater than said predetermined distance away from the room wall such that physical contact of the body-supporting means with the room wall is avoided, said linkage means including a pair of linkage assemblies at opposite sides of the seat, each linkage assembly having a plurality of links, at least some of which extend upwardly from the base rails in vertical direction towards the seat, whereby said some links are prone to undesirable side-to-side play movement in lateral direction and to undesirable twisting movement about an axis in vertical direction;

(c) means for counteracting and minimizing the undesirable lateral side play and the twisting movements, including (i) two pairs of sliding contact elements, each pair being mounted on a respective linkage assembly, said contact elements of each pair being spaced apart of each other in longitudinal direction, (ii) said sliding contact elements having contact faces juxtaposed with the vertical base walls of the base rails for slidably contacting the base walls during movement of the linkage means, to thereby substantially reduce lateral side play and twisting movements; and (d) adjusting means for moving in lateral direction the position of the contact face of one of said sliding contact elements relative to its juxtaposed vertical base wall, said adjusting means including (i) a displaceable element operatively connected to said one sliding contact element, and (ii) means for displacing the displaceable element in lateral direction to move the contact face of said one contact element into sliding abutting relationship with its juxtaposed vertical base wall when the body-supporting means is in its upright position, whereby the seat in its sitting orientation is particularly resistant to instability.

2. The improvement as defined in claim 1; and further comprising abutment means on the vertical base walls of the base rails for affirmatively and simultaneously wedgingly engaging the contact faces of all of the contact elements only when the body-supporting means is in its upright position, to thereby prevent instability of the seat in its sitting orientation.

3. The improvement as defined in claim 2, wherein said abutment means includes a plurality of projections on the base rails, each projection extending from its respective base wall in lateral direction towards its respective inner armrest wall.

4. The improvement as defined in claim 3, wherein each projection has an inclined portion which diverges rearwardly towards an abutment portion, each inclined portion having a ramp face which extends linearly from the respective base wall in lateral direction towards its associated abutment portion, each contact face slidably engaging a respective ramp face and moving along the latter until it reaches the abutment portion whereat the wedging engagement is made.

5. The improvement as defined in claim 1, wherein the displaceable element comprises an elongated threaded shaft, said displacing means being located at one end of the shaft, and said contact element being located at the other end of the shaft; and further comprising locking means intermediate the ends of the shaft for fixing said one contact element in its selected adjusted position.

6. The improvement as defined in claim 1, wherein said contact elements are constituted of friction-reducing material.

7. The improvement as defined in claim 1, wherein said base includes a front and a rear cross rail, each cross rail extending in lateral direction across and beyond the base rails, to thereby prevent tipping of the chair.

8. The improvement as defined in claim 7, wherein said front cross rail is horizontal and wherein said rear cross rail is vertical.

9. The improvement as defined in claim 7; and further comprising a plurality of floor-engaging pads mounted on the cross rails, two of said pads being located at opposite end regions of the front cross rail at locations laterally beyond the base rails, and another of said pads being located in the vicinity of the center of the front cross rail.

* * * * *